US007748244B2

(12) United States Patent
Garza et al.

(10) Patent No.: US 7,748,244 B2
(45) Date of Patent: Jul. 6, 2010

(54) DEADBOLT LOCK ASSEMBLY

(75) Inventors: Jose A. Garza, Houston, TX (US); Kody W. Smajstrla, Victoria, TX (US); Joseph M. Estapa, Houston, TX (US); Troy Dalsing, Kinston, NC (US); Jerry B. Bodily, Denver, CO (US)

(73) Assignee: Schlage Lock Company, Carmel, IN (US)

( * ) Notice: Subject to any disclaimer, the term of this patent is extended or adjusted under 35 U.S.C. 154(b) by 318 days.

(21) Appl. No.: 11/855,288

(22) Filed: Sep. 14, 2007

(65) Prior Publication Data

US 2009/0071204 A1 Mar. 19, 2009

(51) Int. Cl.
*E05B 65/06* (2006.01)

(52) U.S. Cl. ..... 70/134; 70/153; 70/379 R; 70/483; 70/487; 70/DIG. 6; 70/DIG. 9; 70/DIG. 20; 70/DIG. 27; 70/DIG. 42; 292/166; 292/174; 292/359; 292/DIG. 37

(58) Field of Classification Search ..... 70/134, 70/143, 483–485, 487, 379 R, 379 A, 380, 70/150, 151 R, 151 A, 153, DIG. 6, DIG. 20, 70/DIG. 7, DIG. 9, DIG. 27, DIG. 33, DIG. 42; 292/332–336, 166, 174, 253, 359, DIG. 24, 292/DIG. 37, DIG. 44
See application file for complete search history.

(56) References Cited

U.S. PATENT DOCUMENTS

| | | | | | |
|---|---|---|---|---|---|
| 917,685 | A | * | 4/1909 | Voight | 292/92 |
| 1,302,873 | A | | 5/1919 | Stiff | |
| 1,701,099 | A | * | 2/1929 | Clark | 70/92 |
| 3,261,630 | A | | 7/1966 | Chew | |
| 3,917,329 | A | * | 11/1975 | Fujiki et al. | 292/163 |
| 3,944,040 | A | * | 3/1976 | Richard | 194/292 |
| 4,061,383 | A | | 12/1977 | Waldo | |
| 4,561,684 | A | | 12/1985 | Marotto | |
| 4,671,549 | A | | 6/1987 | Marotto et al. | |
| 4,890,870 | A | | 1/1990 | Miron | |
| 5,010,749 | A | * | 4/1991 | Lin | 70/190 |
| 5,044,182 | A | | 9/1991 | Totten | |
| 5,150,592 | A | * | 9/1992 | Lin | 70/190 |
| 5,186,030 | A | * | 2/1993 | Lin | 70/190 |
| 5,199,285 | A | * | 4/1993 | Lin | 70/220 |
| 5,421,074 | A | * | 6/1995 | Moore | 29/401.1 |

(Continued)

FOREIGN PATENT DOCUMENTS

| | | |
|---|---|---|
| GB | 679860 A | 9/1952 |

OTHER PUBLICATIONS

International Search Report and Written Opinion for corresponding International Application No. PCT/US2008/075077 mailed on Jan. 28, 2009.

*Primary Examiner*—Lloyd A Gall
(74) *Attorney, Agent, or Firm*—Michael Best & Friedrich LLP

(57) ABSTRACT

A lock assembly for use with a bolt movable from a retracted position to an extended position. The lock assembly includes an exterior assembly and an interior assembly having an interior actuator manually operable to move the bolt between the retracted position and the extended position. The exterior assembly includes an exterior actuator manually operable to cause the bolt to move from the retracted position to the extended position and inoperable to move the bolt from the extended position to the retracted position.

17 Claims, 12 Drawing Sheets

U.S. PATENT DOCUMENTS 5,713,227 A 2/1998 Turnbo
5,797,286 A * 8/1998 Armstrong ..... 70/224
5,820,177 A 10/1998 Moon
5,918,916 A 7/1999 Kajuch
5,941,581 A 8/1999 Heithe
6,135,512 A 10/2000 Galvin
6,145,358 A * 11/2000 Wu ..... 70/467
6,793,254 B1 9/2004 Galvin
RE40,193 E * 4/2008 Boehlow ..... 70/379 R
7,389,661 B2 * 6/2008 Viviano et al. ..... 70/379 R

* cited by examiner

DEADBOLT LOCK ASSEMBLY

BACKGROUND

The present invention relates to door locks, and more particularly to deadbolt door locks.

Generally, deadbolt locks include an interior thumbturn and an exterior lock cylinder that are operable to move a bolt between extended and retracted positions. In the extended position, the bolt can be received in a pocket defined by a door frame such that the deadbolt locks or retains a door in a closed position. In the retracted position, the deadbolt is typically received within a bore of the door such that a user can open the door. Typically, the deadbolt is movable between the extended and retracted positions by either rotating the interior thumbturn or by inserting a key into the lock cylinder and rotating the key.

SUMMARY

In one embodiment, the invention provides a lock assembly for use with a bolt movable from a retracted position to an extended position. The lock assembly includes an exterior assembly and an interior assembly having an interior actuator manually operable to move the bolt between the retracted position and the extended position. The exterior assembly includes an exterior actuator manually operable to cause the bolt to move from the retracted position to the extended position and inoperable to move the bolt from the extended position to the retracted position.

In another embodiment, the invention provides a lock assembly for use with a bolt movable from a retracted position to an extended position. The lock assembly includes an interior assembly, a lock cylinder and an exterior assembly. The interior assembly includes an interior actuator manually operable to move the bolt between the retracted position and the extended position. The lock cylinder is configured to receive a key and is operable to move the bolt between the retracted position and the extended position. The exterior assembly includes an exterior actuator independent of the lock cylinder and manually movable to cause the bolt to move from the retracted position to the extending position.

In yet another embodiment, the invention provides a deadbolt lock assembly including a bolt movable from a retracted position to an extended position, an interior assembly including a lever manually operable to move the bolt between the retracted position and the extended position, and a lock cylinder configured to receive a key and operable to move the bolt between the retracted position and the extended position. The deadbolt lock assembly further includes an exterior assembly, a driver, a driver actuator, a biasing member, and a latch member. The exterior assembly includes an exterior actuator independent of the lock cylinder and manually movable to cause the bolt to move from the retracted position to the extended position and inoperable to move the bolt from the extended position to the retracted position. The driver extends from the interior assembly to the exterior assembly, and the driver is rotatable from a locked position to an unlocked position such that when the driver is in the locked position, the bolt is in the extended position and when the driver is in the unlocked position, the bolt is in the retracted position. The driver member is coupled to the driver for rotation with the driver, and the driver actuator is rotatable with respect to the driver and movable between a loaded position and an unloaded position. The driver actuator includes an engaging portion selectively engagable with the driver member. The biasing member that biases the driver actuator toward the unloaded position, and the latch member selectively engages the actuator to retain the driver actuator in the loaded position. The exterior actuator is manually operable to disengage the latch member from the driver actuator to cause the biasing member to rotate the driver actuator toward the unloaded position such that the engaging portion of the driver actuator engages the driver member to rotate the driver member and the driver toward the locked position to move the bolt to the extended position.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
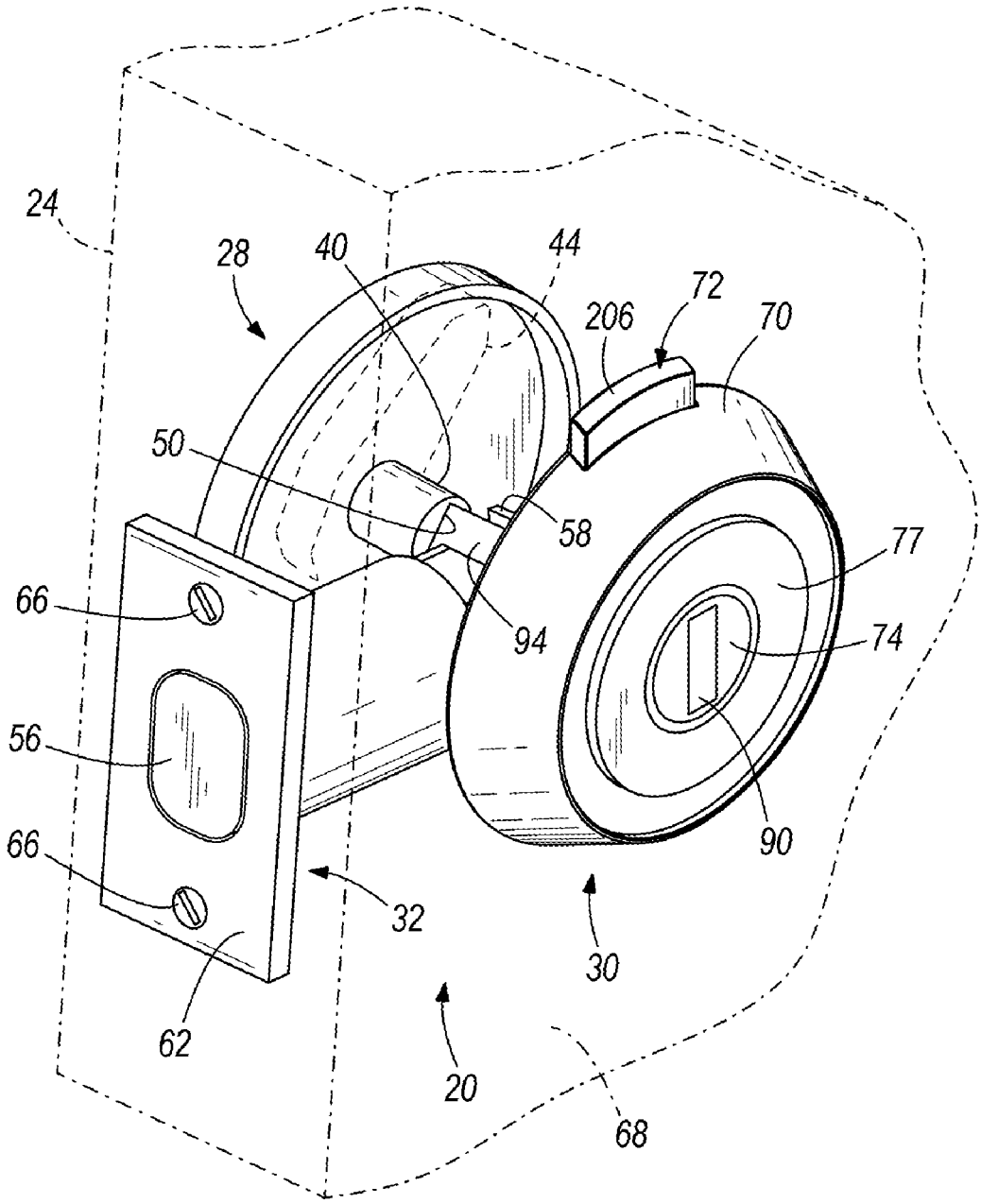
FIG. 1 is a perspective view of a deadbolt lock assembly embodying the present invention with a bolt of the lock assembly in a retracted position.

FIG. 1 illustrates a deadbolt lock assembly 20 for use with a door 24. The deadbolt assembly 20 includes an interior assembly 28, an exterior assembly 30, and a latchbolt assembly 32.

Figure 3:
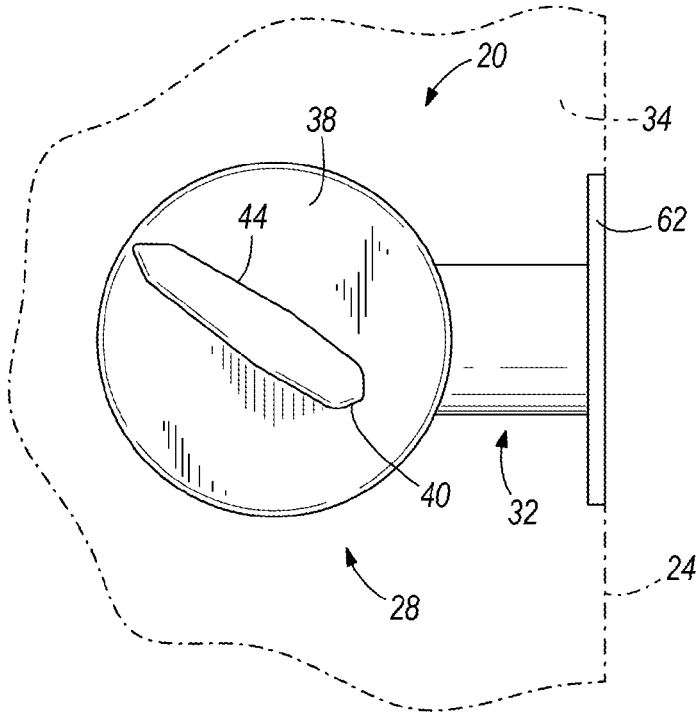
FIG. 3 is an interior elevational view of the lock assembly with the bolt in the retracted position.
Figure 4:
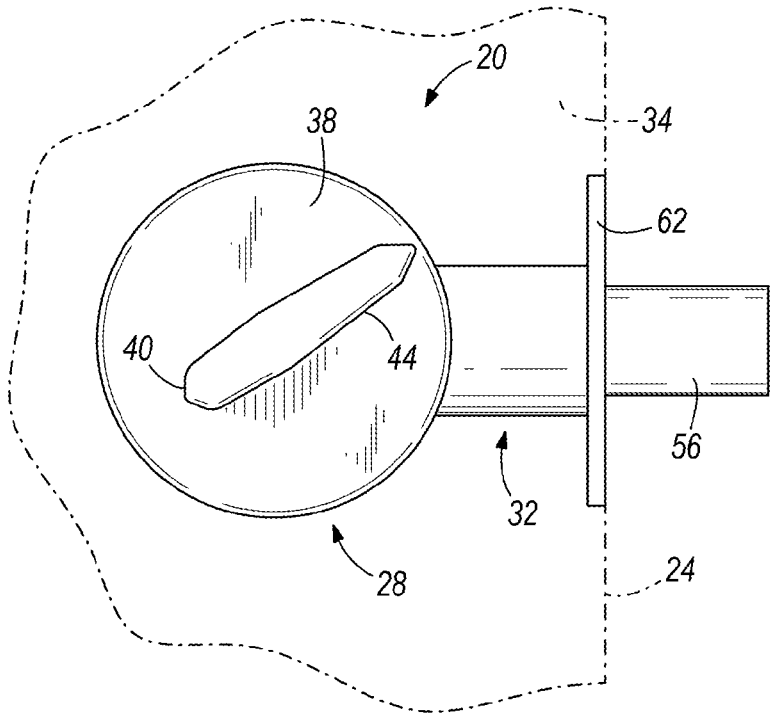
FIG. 4 is an interior elevational view of the lock assembly with the bolt in the extended position.
Figure 5:
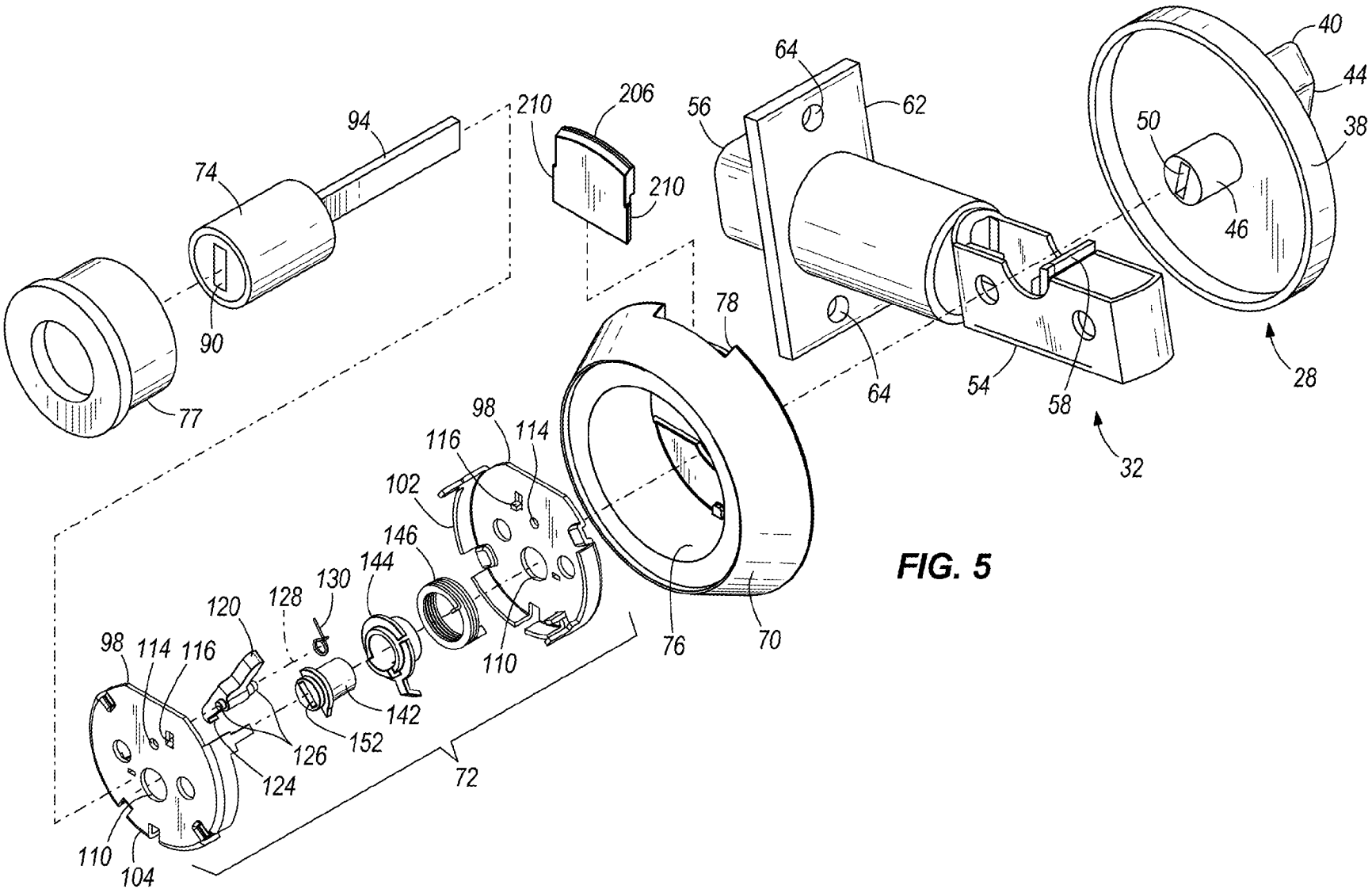
FIG. 5 is an exploded view of the deadbolt lock assembly.
Figure 6:
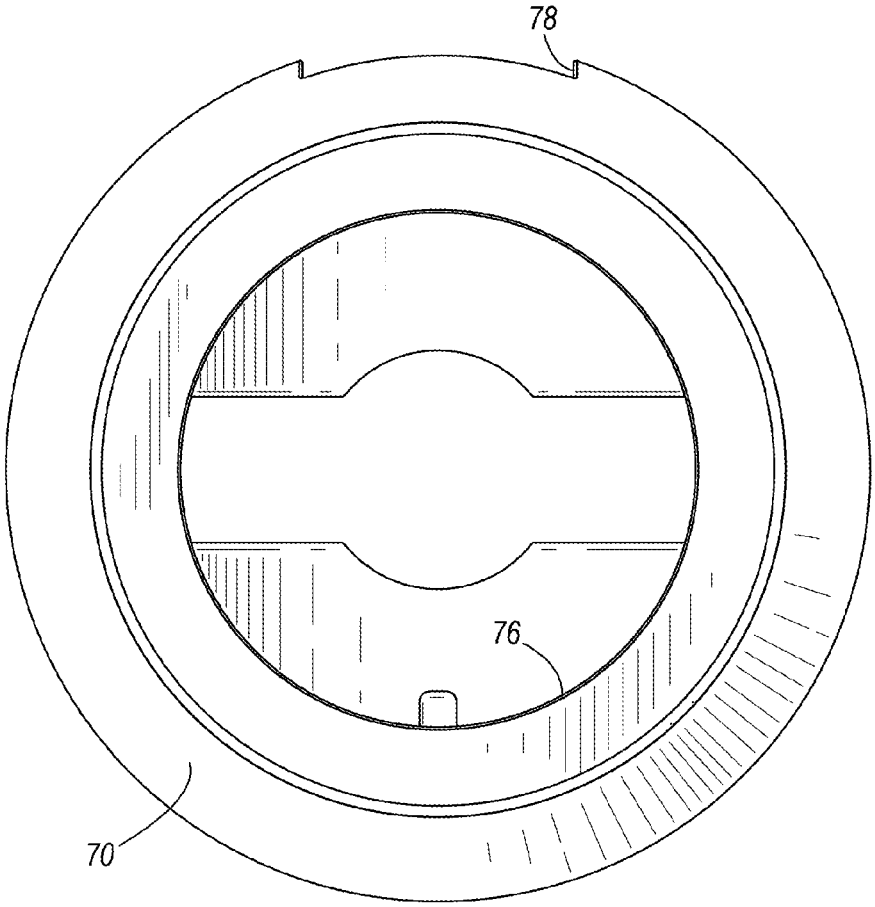
FIG. 6 is an exterior elevational view of an exterior housing of the lock assembly.

Referring to FIGS. 4 and 5, the interior assembly 28 is coupled to and extends from an interior surface 34 of the door 24. The interior assembly 28 includes an interior face plate 38 and an interior actuator 40 coupled to the interior face plate 38. The interior actuator 40 includes a lever or thumbturn 44 and, as best seen in FIG. 5, a cylindrical portion 46 that extends through the face plate 38. The cylindrical portion 46 includes a rectangular blind aperture 50, the purpose of which will be discussed below. Referring to FIGS. 3 and 4, the interior actuator 40 is rotatable with respect to the face plate 38 between a first or unlocked position illustrated in FIG. 3 and a second or locked position illustrated in FIG. 4.

Referring to FIG. 5, the latchbolt assembly 32 is a typical latchbolt known in the art. The latchbolt assembly 32 includes a housing 54, a bolt 56, and a bolt actuator 58. As would be understood by one of skill in the art, the actuator 58 is operable to move the bolt 56 with respect to the housing 54 between a retracted position (see FIG. 1) and an extended position (see FIG. 2). Also, as would be understood by one of skill in the art, when the bolt 56 is in the extended position, the bolt 56 can be received in a pocket or recess defined by a door frame and strike plate to retain or lock the door 24 in a closed position.

Figure 2:
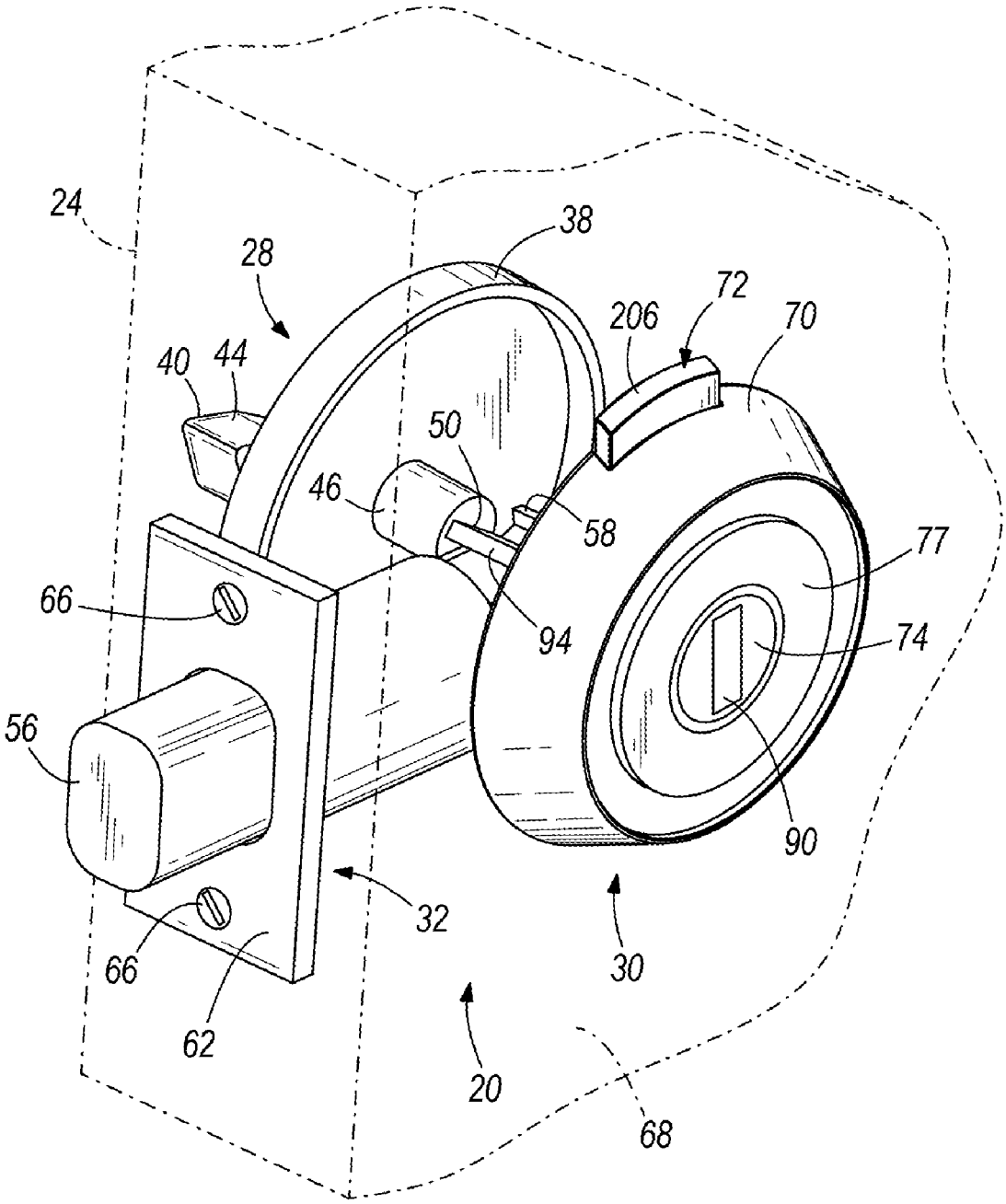
FIG. 2 is a perspective view of the deadbolt lock assembly of FIG. 1 with the bolt in an extended position.

Referring to FIGS. 2 and 5, the latchbolt assembly 32 further includes a plate 62 having apertures 64. The apertures 64 receive screws 66 to couple the latchbolt assembly 32 to the door 24.

Figure 7A:
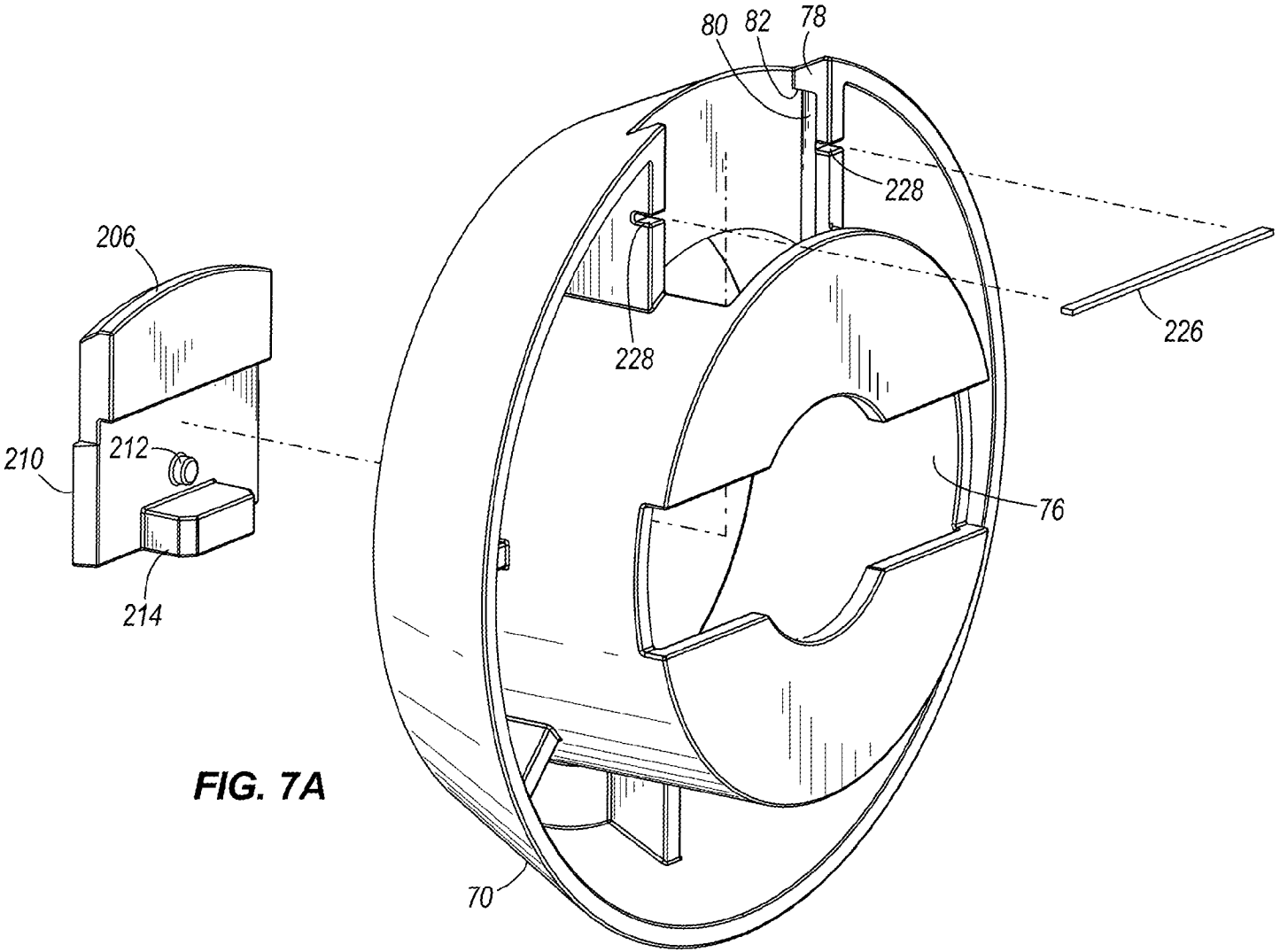
FIG. 7A is an exploded rear perspective view of the exterior housing and a button actuator.

Referring to FIG. 1 the exterior assembly 30 is coupled to and extends from an exterior surface 68 of the door 24. The exterior assembly 30 includes a housing or escutcheon 70, a bolt actuator assembly or exterior actuator assembly 72, and a lock cylinder 74. Referring to FIG. 5, the escutcheon 70 includes a bore 76 that receives the bolt actuator assembly 72 and the lock cylinder 74. The bore 76 further receives a cap 77 to capture and enclose the bolt actuator assembly 72 and the lock cylinder 74 within the bore 76 of the escutcheon 70. Referring to FIG. 7A, the escutcheon 70 further defines a slot 78 and recesses 80 formed in the sides of the slot 78. While only one of the recesses 80 is visible in FIG. 7A, a similar recess is formed in the slot 78 opposite the visible recess 80. The recesses 80 define a stop 82 or upper end. The purpose of the slot 78, the recesses 80 and the stops 82 will be discussed in more detail below.

Referring to FIG. 5, the lock cylinder 74 includes a slot 90 that receives a key. As would be understood by one of skill in the art, the key is rotatable to rotate a driver 94 that is coupled to and extends from the lock cylinder 74. Referring to FIGS. 1 and 5, the driver 94 extends from the exterior assembly 30 to the interior assembly 28 and the driver 94 is received by the rectangular aperture 50 of the interior actuator 40. The rectangular aperture 50 and the driver 94 are sized such that rotation of the interior actuator 40 also rotates the driver 94.

With continued reference to FIG. 5, the bolt actuator assembly 72 includes a housing 98 that is received in the bore 76 of the exterior assembly escutcheon 70. The illustrated housing 98 is a two-piece housing that includes an interior member 102 and an exterior member 104. In the illustrated construction, the interior and exterior housing members 102 and 104 are the same, but are rotated 180 degrees with respect to each other as illustrated in FIG. 5, and therefore, like components have been given the same reference numbers.

The interior and exterior housing members 102 and 104 each include a driver aperture 110 through which the driver 94 extends. The housing members 102 and 104 each further include a latch member aperture 114 and a tab 116.

Figure 8:
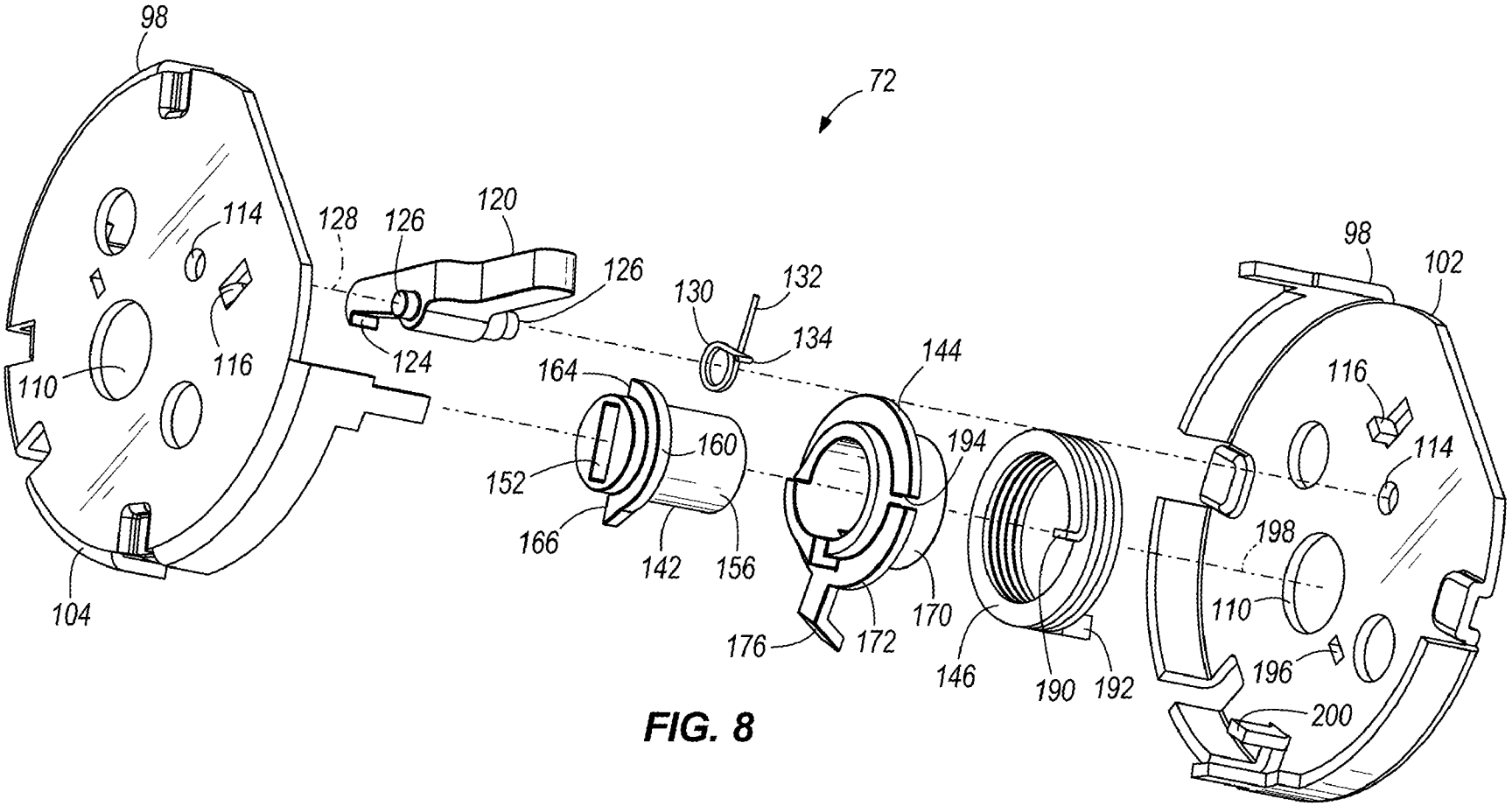
FIG. 8 is an exploded perspective view of a bolt actuator assembly of the lock assembly.
Figure 12:
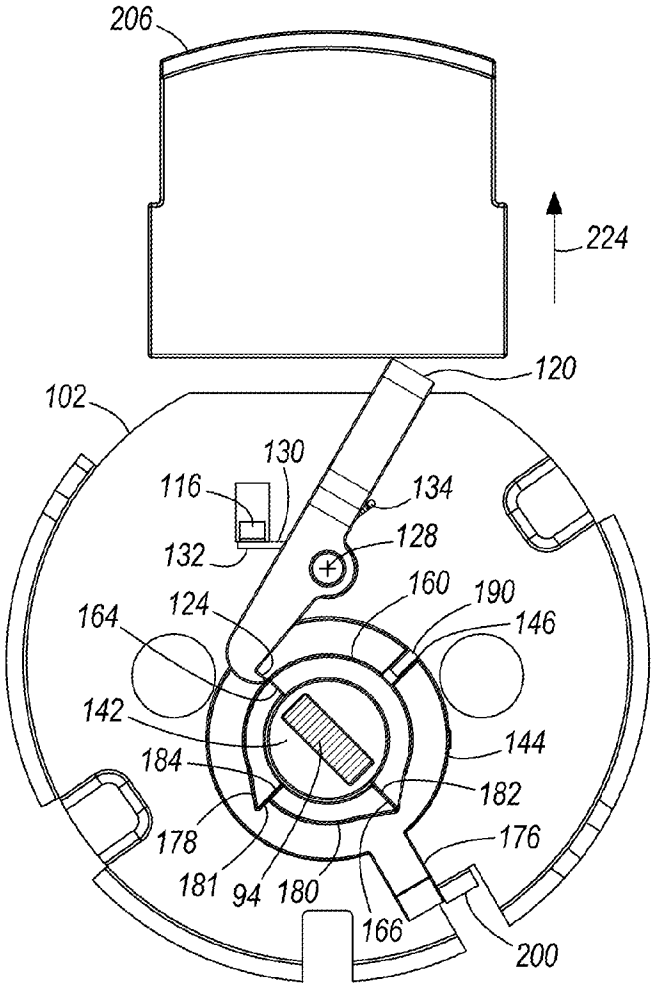
FIG. 12 is an elevational view of a portion of the lock assembly illustrating a driver in a locked position and the driver actuator in an unloaded position.

Referring to FIGS. 5 and 8, the bolt actuator assembly 72 further includes a latch member 120. The latch member 120 includes a hook 124 and trunnions 126. The trunnions 126 are received by the apertures 114 of the housing members 102 and 104 such that the latch member 120 can pivot or rotate with respect to the housing members 102 and 104 about an axis 128. A biasing member 130, which is a torsion spring in the illustrated construction, is utilized to bias the latch member 120. The torsion spring 130 includes a first end portion 132 and a second end portion 134, and as best seen in FIG. 12, the first end portion 132 is retained by the tab 116 and the second end portion 134 acts against the latch member 120 to bias the latch member 120 counterclockwise about the axis 128.

Referring to FIG. 8, the bolt actuator assembly 72 further includes a driver member 142, a driver actuator 144, and a biasing member 146. The driver member 142 has therethrough a rectangular aperture 152 that is sized to receive the driver 94 (FIG. 5) such that the driver 94 and the driver member 142 are coupled for co-rotation. The driver member 142 further includes an exterior surface 156 that defines a cylinder. An actuator engaging projection 160 having first end 164 and a second end 166 extends from the exterior surface 156 and extends about 180 degrees around the exterior surface 156.

Figure 9:
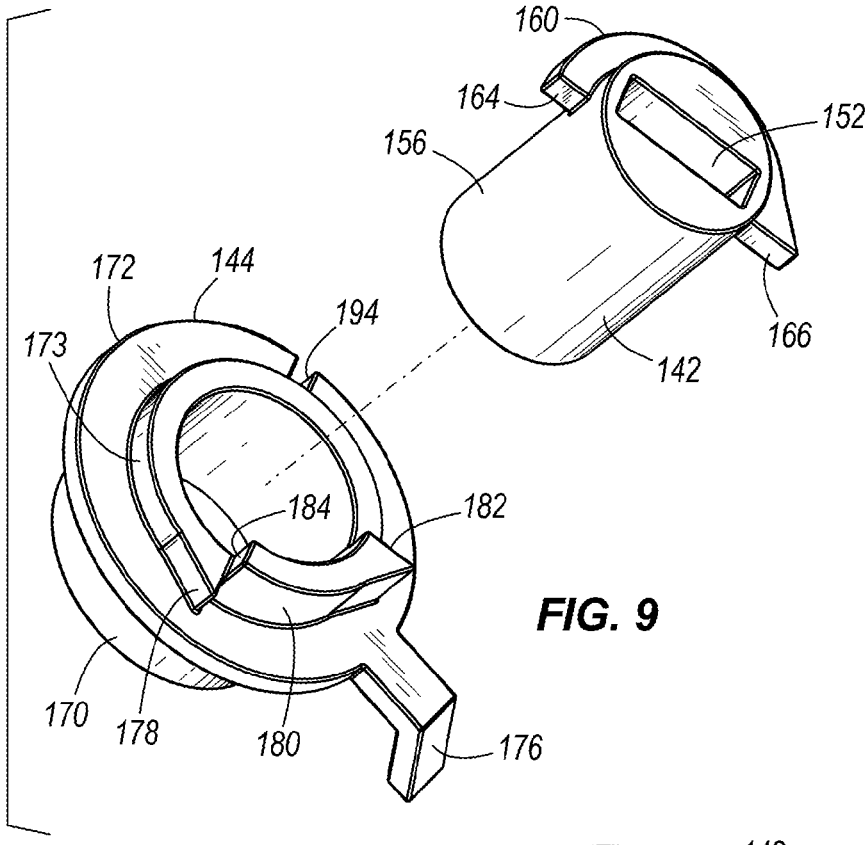
FIG. 9 is an exploded perspective view of a driver member and a driver actuator of the lock assembly.
Figure 10:
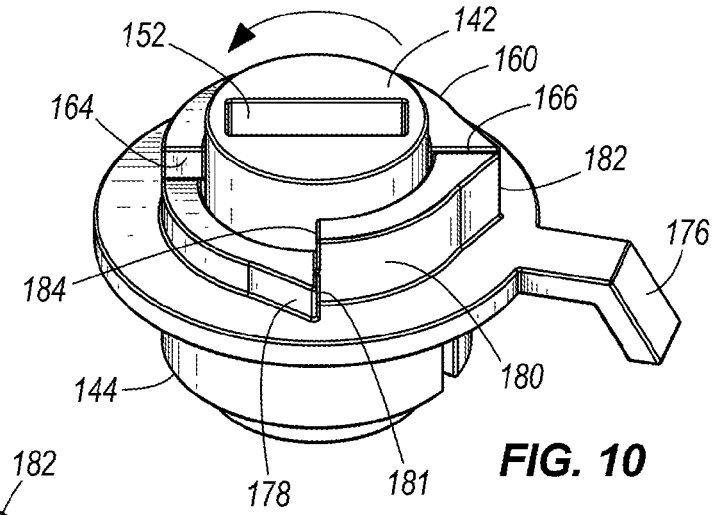
FIG. 10 is a perspective view of the driver member and the driver actuator the driver member in a first position with respect to the driver actuator.

Referring to FIGS. 8 and 9, the driver actuator 144 includes a tubular base or cylindrical portion 170 and a flange 172 that radially extends from the base 170. The base 170 has a cylindrical outer surface 173. A radial arm 176 extends from the flange 172. A ramped latch engaging projection 178 extends radially from the base 170, and an extension 180 extends axially from an end of the base 170. Extension or projection 178 has a planar end surface 181 (FIGS. 10 and 12). The extension 180 includes an enlarged ramped first end 182 and a second end 184 and the extension 180 extends about 90 degrees around the end of the base 170.

Figure 11:
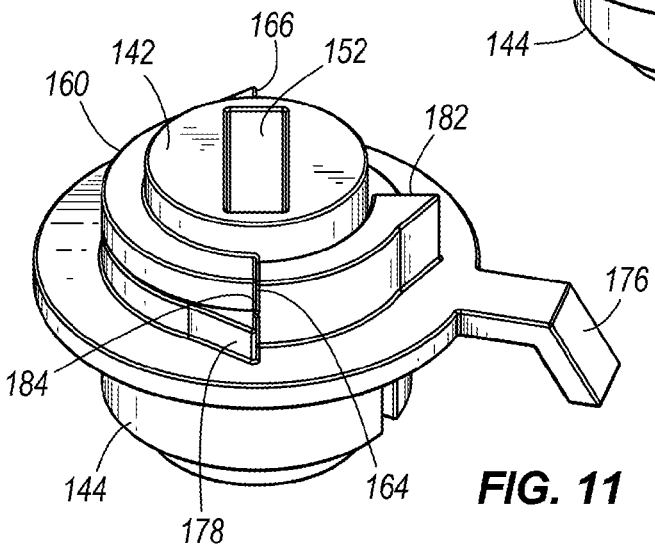
FIG. 11 is a perspective view of the driver member and the driver actuator with the driver member in a second position with respect to the driver actuator.

Referring to FIG. 9-11, the driver member 142 is received by the base 170 and the underside of the projection 160 of the driver member 142 abuts the upper end of the base 170 as illustrated in FIG. 10. The driver member 142 is coupled to the driver actuator 144 such that the driver member 142 can rotate with respect to the driver actuator 144. Comparing FIGS. 10 and 11, the driver member 142 is rotatable through an angle of about ninety degrees with respect to the driver actuator 144. In a first position (FIG. 10), the enlarged second end 166 of the projection 160 abuts the enlarged end 182 of the extension 180, and in a second position (FIG. 11), the end 164 of the projection 160 abuts the end 184 of the extension 180.

Referring to FIG. 8, the biasing member 146, which is a torsion spring in the illustrated construction, includes a first tab 190 and a second tab 192. The tab 190 is received in a slot 194 formed in the flange 172 of the driver actuator 144 and the tab 192 is received in an aperture 196 of the housing member 102. The spring 146 biases the driver actuator 144 about an axis 198 of the driver 94 (see FIG. 5), and in the counterclockwise direction as illustrated in FIG. 12 such that the radial arm 176 of the driver actuator abuts a tab 200 of the housing member 102.

Figure 7B:
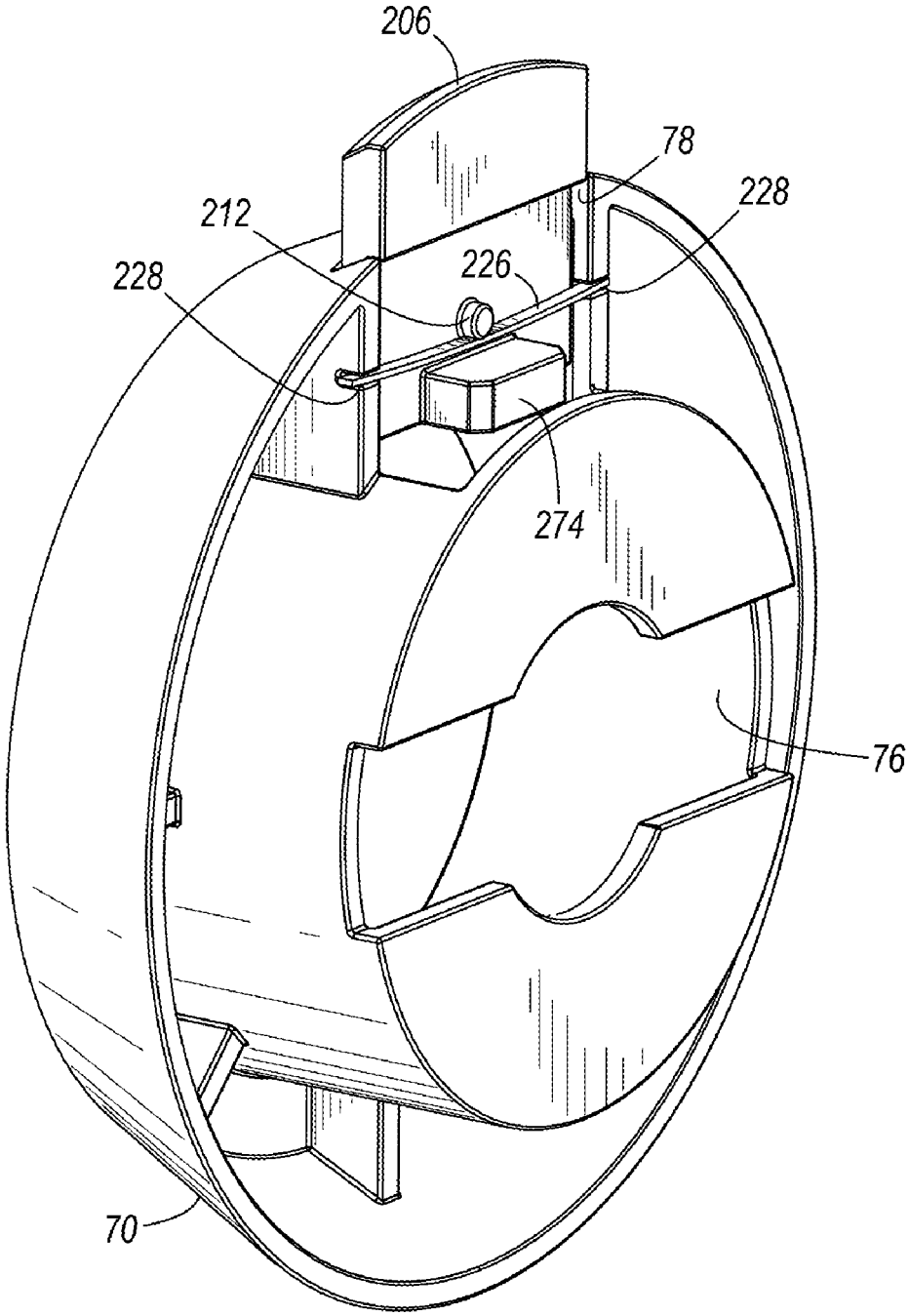
FIG. 7B is a rear perspective view of the exterior housing and the button actuator.

Referring to FIGS. 5, 7A, and 7B, the bolt actuator assembly 72 further includes a button 206. The button 206 includes guides 210 that are received in the slots 80 of the exterior escutcheon 70. In an upper position of the button 206 (see FIG. 7B), the guides 210 abut the upper ends 82 of the slots 80 to limit the upward movement of the button 206. Referring to FIGS. 7A and 7B, the button 206 further includes a protrusion 212 and an enlarged engagement portion 214. Referring to FIGS. 7A, 7B, and 12, when the deadbolt lock assembly 20 is assembled, the latch member 120, which is biased counterclockwise by the torsion spring 130, contacts the engagement portion 214 of the button 206 to bias the button upwardly in the direction of arrow 224 of FIG. 12. In addition, referring to FIG. 7B, a leaf spring 226, which is received in recesses 228 of the escutcheon 70, extends underneath the button 212 to further bias the button 206 upward. However, the ends 82 of the recesses 80 (see FIG. 7B) limit the upward movement of the button 206.

In operation, referring to FIGS. 2 and 4, when the thumbturn 44 is in the locked position illustrated in FIG. 4, the bolt 56 is in the extended position and the deadbolt lock assembly 20 is in a locked configuration. As would be understood by one of skill in the art, when the deadbolt lock assembly 20 is in the locked configuration, the bolt 56 can be received in a pocket defined by a door frame and a strike to retain the door 24 in a closed or locked position.

When the user desires to unlock the deadbolt lock assembly 20, the user can rotate the thumbturn 44 from the locked position (FIG. 4) to the unlocked position (FIG. 3) to retract the bolt 56. Referring to FIG. 1, because the driver 94 is received in the rectangular aperture 50 of the interior actuator 40, rotation of the thumbturn 44 also rotates the driver 94 from a locked position (FIG. 2) to an unlocked position (FIG. 1). As the driver 94 rotates from the locked position to the unlocked position, as would be understood by one of skill in the art, the driver 94 contacts the bolt actuator 58 of the latchbolt assembly 32 to retract the bolt 56 to the position illustrated in FIG. 1. In addition, the lock cylinder 74 can also be utilized by inserting a key into the slot 90 and rotating the key to move the driver 94 between the locked and unlocked positions, and therefore the bolt 56 between the extended and retracted positions.

Figure 13:
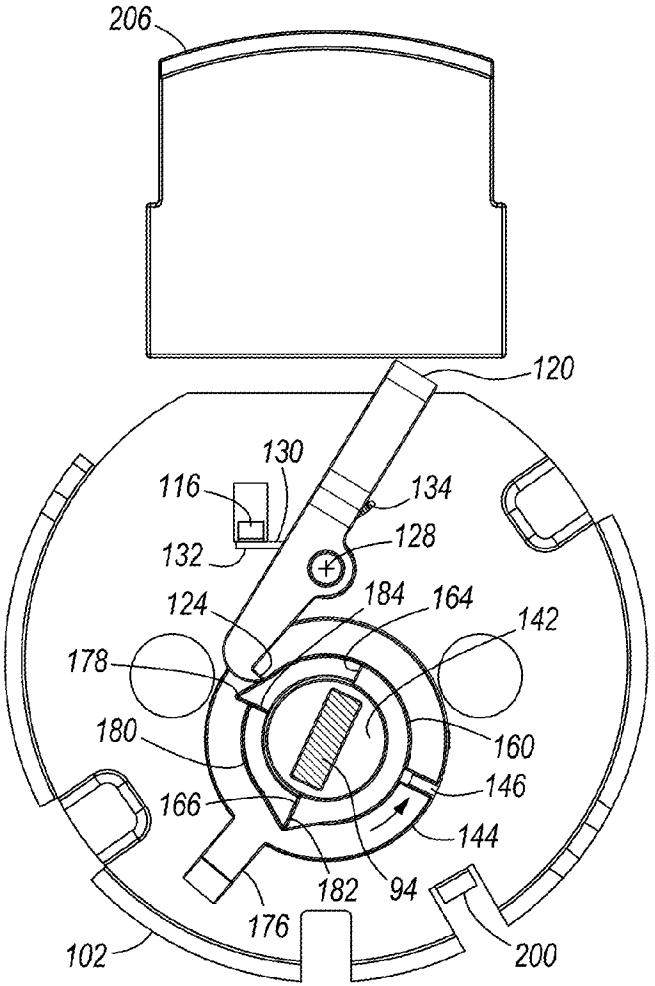
FIG. 13 is a view similar to FIG. 12 illustrating the driver of the lock assembly between the locked position and an unlocked position and the driver actuator between the unloaded position and a loaded position.

FIG. 12 illustrates the driver 94 in the locked position such that the bolt 56 (FIG. 4) is in the extended position. As the user rotates the driver 94 using the locking cylinder 74 or the thumbturn 44 (FIG. 1) to retract the bolt 56, the driver 94 and the driver member 142, which is coupled for rotation with the driver 94, rotate in the clockwise direction as illustrated in FIG. 13. FIG. 13 illustrates the driver 94 between the locked and unlocked positions. Furthermore, referring to FIGS. 9, 10 and 12, when the driver member 142 is in the position as illustrated in FIG. 12, the end 166 of the projection 160 abuts the end 182 of the extension 180 of the driver actuator 144. Accordingly, referring to FIGS. 12 and 13, as the driver member 142 rotates clockwise with the driver 94, the driver member 142 contacts the driver actuator 144 to rotate the driver actuator 144 against the bias of the torsion spring 146. Therefore, as the user rotates the driver 94 (FIG. 1) from the locked position toward the unlocked position, the user loads the torsion spring 146 (FIG. 8). Meanwhile, the latch member 120, which is biased in the counterclockwise direction about the axis 128, rides along the outer surface 173 of the driver actuator 144.

Figure 14:
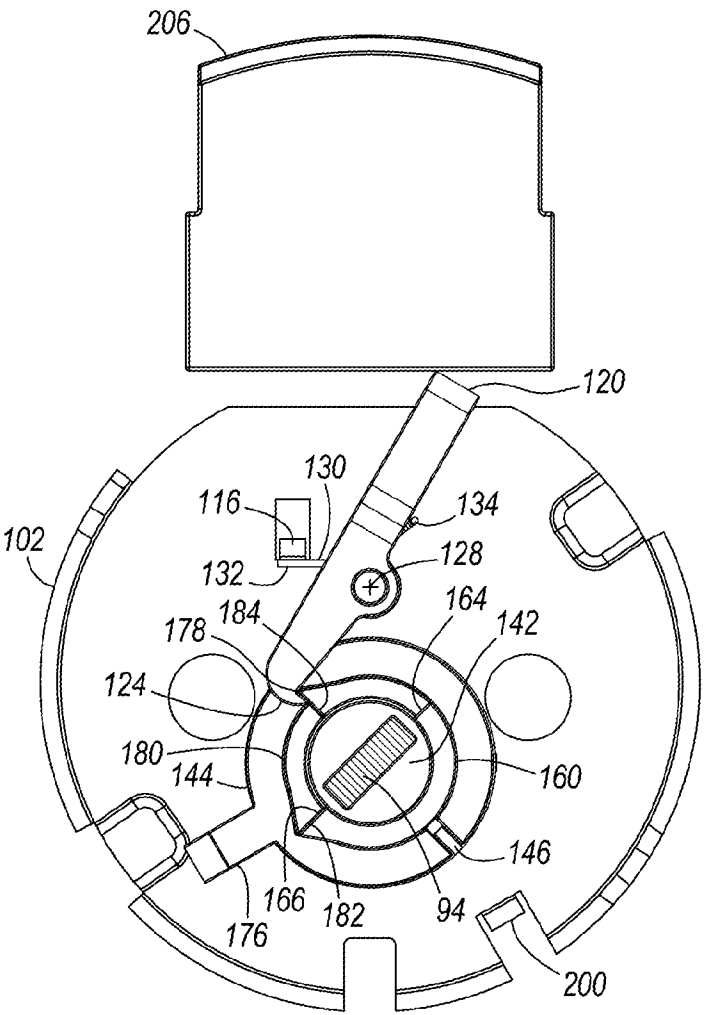
FIG. 14 is a view similar to FIG. 12 illustrating the driver in the unlocked position and the driver actuator in the loaded position.

Referring to FIG. 14, the driver member 142 continues to rotate the driver actuator 144 in the clockwise direction until the driver 94 reaches the unlocked position (FIG. 1). When the driver 94 reaches the unlocked position, the hook 124 of the latch member 120 engages the end surface 181 of the projection 178 to retain the latch actuator 144 in a loaded position against the counterclockwise bias of the torsion spring 146.

Figure 15:
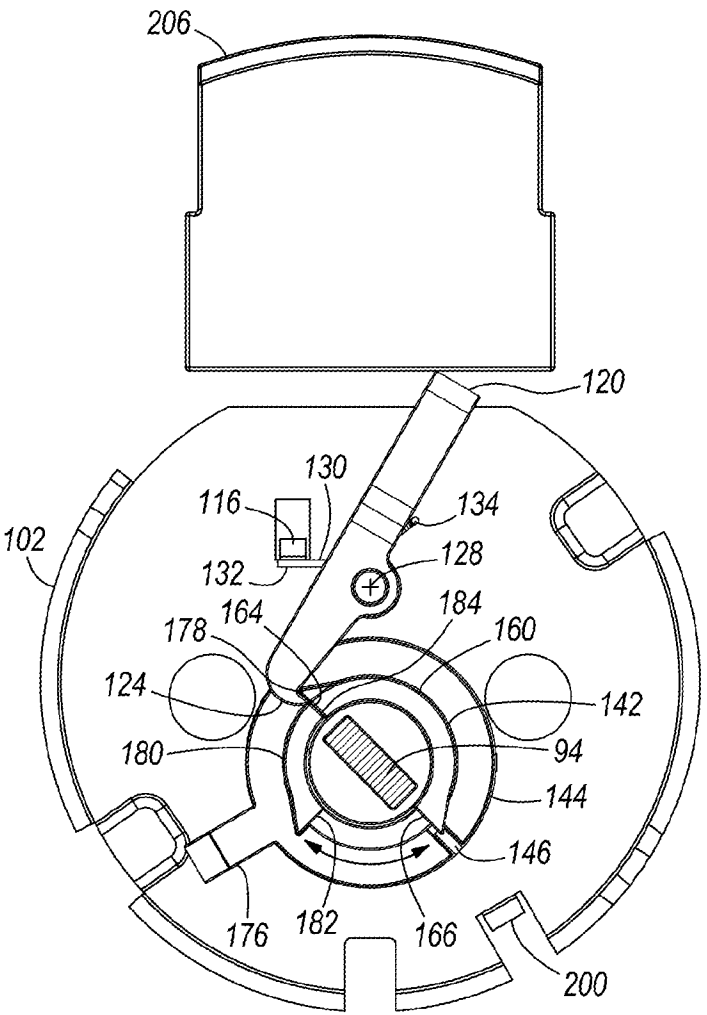
FIG. 15 is a view similar to FIG. 12 illustrating the driver in the locked position and the driver actuator in the loaded position.

With the latch actuator 144 in the loaded position, as illustrated in FIG. 15, the user can move the driver 94 back and forth between the locked and unlocked positions while the latch actuator 144 remains in the loaded position. Thus, the user can use the thumbturn 44 or the lock cylinder 74 (FIGS. 1 and 2) to move the bolt 56 back and forth between the extended and retracted positions. The driver member 142 is pivotable relative to the latch actuator 144 between the position shown in FIGS. 14 and 10 (unlocked) and the position shown in FIGS. 15 and 11 (locked), while the driver actuator 144 remains in the loaded position.

Figure 16:
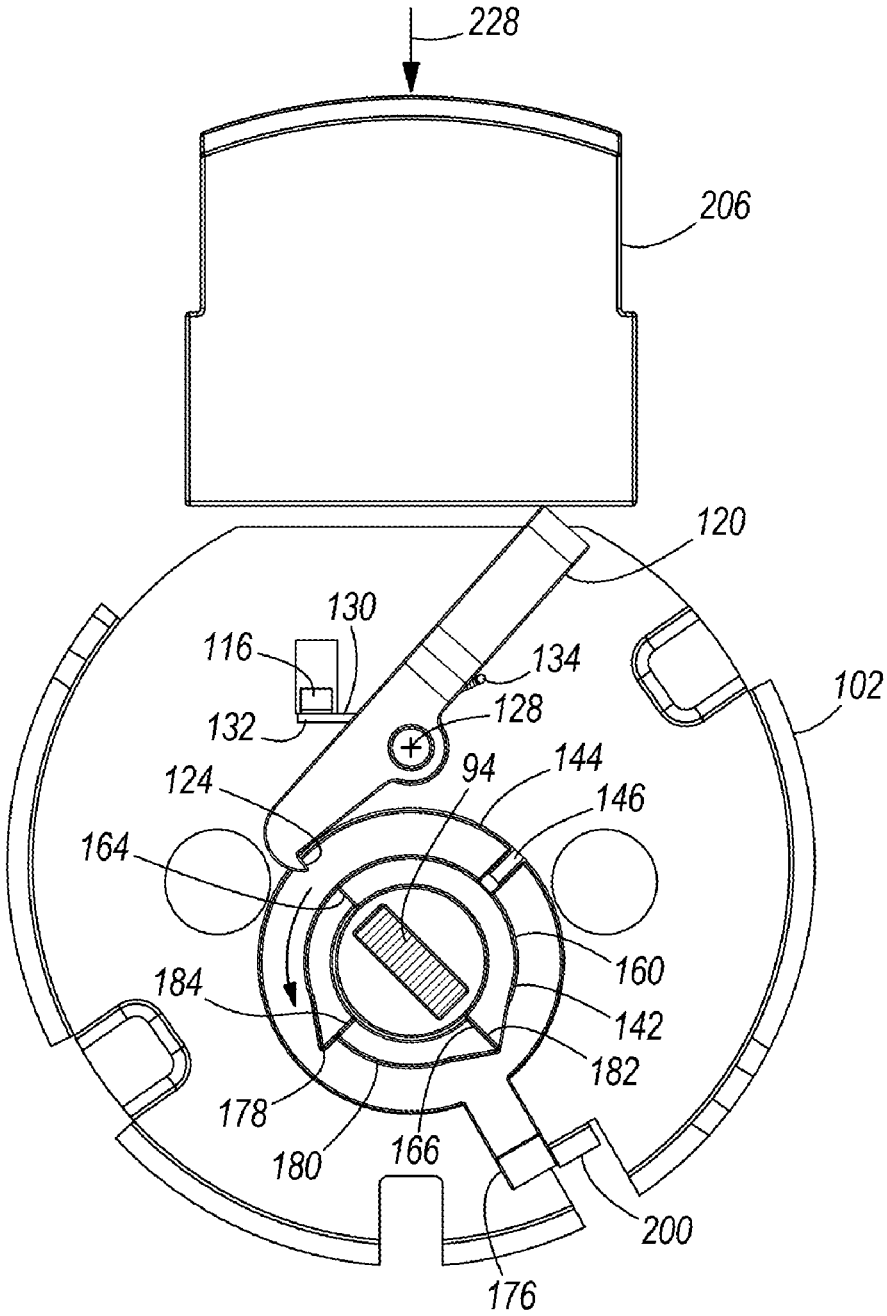
FIG. 16 is a view similar to FIG. 12 illustrating a latch member of the lock assembly in an unlatched position, the driver in the locked position, and the driver actuator in the unloaded position.

Referring to FIG. 14, with the driver actuator 144 in the loaded position and the driver 94 in the unlocked position, and thus the bolt 56 (FIG. 1) in the retracted position, the user can use the exterior bolt actuator 72 to throw the bolt 56 from the retracted position (FIG. 1) to the extended position (FIG. 2). Referring to FIGS. 14 and 16, if the user presses downwardly (in the direction of arrow 228 of FIG. 16) on the button 206, the button 206 contacts the latch 120 to rotate the latch 120 clockwise about the axis 128 against the bias of the spring 130. Clockwise rotation of the latch 120 disengages the hook 124 from the projection 178 of the driver actuator 144 to allow the spring 146 to rotate the driver actuator 144 in the counterclockwise direction to the position shown in FIG. 16. With the driver 94 starting in the unlocked position (FIG. 14), when the driver actuator 144 rotates in the counterclockwise direction, the end 182 of the projection 180 of the driver actuator 144 contacts the end 166 of the projection 160 of the driver member 142 to rotate the driver member 142 with the driver actuator 144 in the counterclockwise direction. The driver actuator 144 rotates in the counterclockwise direction until the radial arm 176 of the driver actuator 144 contacts the tab 200 of the housing 102 as shown in FIG. 16. Rotation of the driver member 142 rotates the driver 94, which causes the bolt 56 (FIG. 1) to move from the retracted position (FIG. 1) to the extended position (FIG. 2). The driver actuator 144 is moved back to the loaded position of FIGS. 14 and 15 the next time the user moves the bolt 56 (FIG. 1) back to the retracted position, such as by using the thumbturn 44 (FIG. 3) or by using a key and the lock cylinder 74 (FIG. 1) as discussed above.

Referring to FIGS. 1-4, the bolt actuator assembly 72 of the deadbolt lock assembly 20 allows the user to throw the bolt 56 (i.e., move the bolt 56 from the extended position to the retracted position) by pressing the button 206. Furthermore, by pressing the button 206 of the bolt actuator assembly 72, the user the can throw the bolt 56 without using a key and the lock cylinder 74. The bolt actuator assembly 72 operates independently from the lock cylinder 74.

Thus, after the user exits and closes the door 24, the user can simply press the button 206 to throw the bolt 56 without using a key. However, when the bolt 56 is extended, the button 206 and the bolt actuator assembly 72 are inoperable to move the bolt 56 back to the retracted position. When the user desires to unlock the lock assembly 20, the user can use a key and the lock cylinder 74 from the exterior side 68 of the door 24 or the thumbturn 44 from the interior side 34 of the door 24. As discussed above, when the user unlocks the lock assembly 20 after using the button 206 to throw the bolt 56, the lock assembly 20 is returned to the loaded position such that the button 206 of the bolt actuator assembly 72 can be utilized to throw the bolt 56.

Referring to FIGS. 4 and 5, while the lock assembly 20 has been illustrated and described for use with a door in a left hand configuration (i.e., the door 24 hinges on the user's left when pulled toward the user), the bolt actuator 72 can be utilized in a lock assembly in a right hand configuration (i.e., the door 24 hinges on the user's right when pulled toward the user). To utilize the bolt actuator 72 in a right hand configuration, the bolt actuator is rotated such that the housing member 102 faces outwardly and the housing member 104 faces inwardly.

Various features and advantages of the invention are set forth in the following claims.

What is claimed is:

1. A lock assembly for use with a bolt movable from a retracted position to an extended position, the lock assembly comprising:

an interior assembly including an interior actuator manually operable to move the bolt between the retracted position and the extended position;

an exterior assembly including an exterior actuator manually operable to cause the bolt to move from the retracted position to the extended position and inoperable to move the bolt from the extended position to the retracted position;

a driver extending from the interior assembly to the exterior assembly, the driver rotatable from a locked position to an unlocked position such that when the driver is in the locked position, the bolt is in the extended position and when the driver is in the unlocked position, the bolt is in the retracted position;

a driver member coupled to the driver for rotation with the driver;

a driver actuator rotatable with respect to the driver and movable between a loaded position and an unloaded position, the driver actuator including an engaging portion selectively engagable with the driver member;

a biasing member that biases the driver actuator toward the unloaded position; and a latch member that selectively engages the driver actuator to retain the driver actuator in the loaded position, wherein the exterior actuator is manually operable to disengage the latch member from the driver actuator to cause the biasing member to rotate the driver actuator toward the unloaded position such that the engaging portion of the driver actuator engages the driver member to rotate the driver member and the driver toward the locked position to move the bolt to the extended position.

2. The lock assembly of claim 1, wherein the lock assembly is a deadbolt lock assembly.

3. The lock assembly of claim 1, wherein the exterior assembly further includes a second exterior actuator operable to move the bolt between the extended position and the retracted position.

4. The lock assembly of claim 3, wherein the second exterior actuator includes a lock cylinder configured to receive a key such that rotation of the key moves the bolt between the extended position and the retracted position.

5. The lock assembly of claim 1, wherein the exterior actuator includes a button manually depressible to cause the bolt to move from the retracted position to the extended position.

6. The lock assembly of claim 1, wherein the latch member includes a hook portion that engages the driver actuator to retain the driver actuator in the loaded position.

7. The lock assembly of claim 6, wherein the exterior actuator includes a button manually depressible to disengage the hook portion of the latch member from the driver actuator to allow the biasing member to move the driver actuator to the unloaded position thereby causing the bolt to move from the retracted position to the extended position.

8. The lock assembly of claim 1, wherein the interior actuator includes a rotatable lever.

9. The lock assembly of claim 1, wherein the biasing member includes a torsion spring.

10. A lock assembly for use with a bolt movable from a retracted position to an extended position, the lock assembly comprising:

an interior assembly including an interior actuator manually operable to move the bolt between the retracted position and the extended position;

a lock cylinder configured to receive a key and operable to move the bolt between the retracted position and the extended position;

an exterior assembly including an exterior actuator independent of the lock cylinder and manually movable to cause the bolt to move from the retracted position to the extended position;

a driver rotatable from a locked position to an unlocked position to move the bolt from the extended position when the driver is in the locked position to the retracted position when the driver is in the unlocked position, the interior actuator coupled to the driver such that the interior actuator is manually operable to move the driver between the locked position and the unlocked position;

a driver actuator movable between a loaded position and an unloaded position, the exterior assembly configured to retain the driver actuator in the loaded position; and a biasing member that biases the driver actuator toward the unloaded position, wherein the bolt is in the extended position when the driver actuator is in the unloaded position, wherein the exterior actuator is manually operable to allow the biasing member to move the driver actuator toward the unloaded position thereby causing the bolt to move from the retracted position to the extended position, and wherein the driver is rotatable with respect to the driver actuator between the locked position and the unlocked position when the driver actuator is in the loaded position.

11. The lock assembly of claim 10, wherein the exterior actuator is generally inoperable to move the bolt from the extended position to the retracted position.

12. The lock assembly of claim 10, wherein the lock assembly is a deadbolt lock assembly.

13. The lock assembly of claim 10, wherein the exterior actuator includes a button manually depressible to cause the bolt to move from the retracted position to the extended position.

14. The lock assembly of claim 13, wherein the exterior actuator further includes a latch member including a hook portion that engages the driver actuator to retain the driver actuator in the loaded position.

15. The lock assembly of claim 14, wherein the exterior actuator includes a button manually depressible to disengage the hook portion of the latch member from the driver actuator to allow the biasing member to move the driver actuator to the unloaded position thereby causing the bolt to move from the retracted position to the extended position.

16. The lock assembly of claim 10, wherein the biasing member includes a torsion spring.

17. A deadbolt lock assembly comprising:

a bolt movable from a retracted position to an extended position;

an interior assembly including a lever manually operable to move the bolt between the retracted position and the extended position;

a lock cylinder configured to receive a key and operable to move the bolt between the retracted position and the extended position;

an exterior assembly including an exterior actuator independent of the lock cylinder and manually movable to cause the bolt to move from the retracted position to the extended position and inoperable to move the bolt from the extended position to the refracted position;

a driver extending from the interior assembly to the exterior assembly, the driver rotatable from a locked position to an unlocked position such that when the driver is in the locked position, the bolt is in the extended position and when the driver is in the unlocked position, the bolt is in the retracted position;

a driver member coupled to the driver for rotation with the driver;

a driver actuator rotatable with respect to the driver and movable between a loaded position and an unloaded position, the driver actuator including an engaging portion selectively engagable with the driver member;

a biasing member that biases the driver actuator toward the unloaded position; and a latch member that selectively engages the driver actuator to retain the driver actuator in the loaded position;

wherein the exterior actuator is manually operable to disengage the latch member from the driver actuator to cause the biasing member to rotate the driver actuator toward the unloaded position such that the engaging portion of the driver actuator engages the driver member to rotate the driver member and the driver toward the locked position to move the bolt to the extended position.

* * * * *